US006570105B1

(12) United States Patent
Sallam et al.

(10) Patent No.: US 6,570,105 B1
(45) Date of Patent: May 27, 2003

(54) RETRACTABLE ROTARY SWITCH CELL

(75) Inventors: Faisal Kassim Sallam, Dearborn, MI (US); Michael James Moldoch, Romulus, MI (US)

(73) Assignee: Lear Corporation, Southfield, MI ( * ) Notice: Subject to any disclaimer, the term of this patent is extended or adjusted under 35 U.S.C. 154(b) by 0 days.

(21) Appl. No.: 10/139,488

(22) Filed: May 6, 2002

(51) Int. Cl.[7] ..... H01H 9/00

(52) U.S. Cl. ..... 200/4; 200/18; 200/16 R; 200/1 R; 200/5 R; 200/518; 338/162; 338/190

(58) Field of Search ..... 200/4, 18, 16 R, 200/16 C, 16 D, 5 R, 1 R, 11 R, 14, 110 A, 518, 519, 570, 336; 338/162, 170, 172, 200, 190

(56) References Cited

U.S. PATENT DOCUMENTS

| | | | | |
|---|---|---|---|---|
| 2,669,611 A | | 2/1954 | Silvius | |
| 4,131,033 A | * | 12/1978 | Wright et al. | 74/553 |
| 4,164,633 A | | 8/1979 | Sheridan et al. | |
| 4,455,458 A | * | 6/1984 | Oyama | 200/1 B |
| 4,518,832 A | | 5/1985 | Geremia | |
| 5,264,821 A | | 11/1993 | Vultaggio et al. | |
| 5,546,067 A | * | 8/1996 | Schmidt et al. | 338/172 |
| 5,736,696 A | | 4/1998 | Del Rosso | |
| 5,939,683 A | * | 8/1999 | Hoskins et al. | 200/5 R |
| 5,945,647 A | | 8/1999 | Hoskins | |
| 6,236,002 B1 | * | 5/2001 | Chou | 200/4 |
| 6,329,898 B1 | * | 12/2001 | Mizobuchi | 338/162 |

* cited by examiner

*Primary Examiner*—Elvin Enad
*Assistant Examiner*—K. Lee
(74) *Attorney, Agent, or Firm*—Brooks & Kushman, P.C.

(57) ABSTRACT

A push-pull rotary switch includes a board having two circuits on opposite sides. Conductors are respectively positioned above the circuits for contacting ground and contact pads of the circuits. A shaft extends through the conductors and the board and is rotatable and moveable between inward and outward positions. The conductors are connected to the shaft to rotate and move with the shaft. A first conductor contacts the ground pad and a contact pad of a first circuit when the shaft is in the inward position. A second conductor contacts the ground pad and a contact pad of a second circuit when the shaft is in the outward position. A first trace is connected to the first circuit ground pad and a second trace is connected to the second circuit ground pad. A contactor connects a ground trace to at least one of the first and second traces at all times.

16 Claims, 8 Drawing Sheets

RETRACTABLE ROTARY SWITCH CELL

BACKGROUND OF THE INVENTION

1. Field of the Invention

The present invention relates generally to push-pull rotary switches and, more particularly, to a push-pull rotary switch having two electrical circuits in which at least one of the two electrical circuits is enabled at all times as the switch is pushed and pulled between inward and outward positions.

2. Background Art

Push-pull rotary switches are used in the automotive industry and are typically installed in the dashboards of automobiles. Typical applications of push-pull rotary switches include automobile lighting and window wiping control. A typical push-pull rotary switch includes a shaft which can be rotated about an axis and which can be moved along the axis between inward and outward positions. An operator can push the switch into the inward position and pull the switch into the outward position. The operator can further rotate the switch when the switch is in the inward or outward position.

Generally, such a switch is configured such that the inward and outward positions of the shaft enable the switch to control separate functions of a device such as a light. For example, the operator can push the shaft of the switch into the inward position in order to cause the switch to turn the light off. Similarly, the operator can pull the shaft of the switch into the outward position in order to cause the switch to turn the light on. The switch is further configured such that rotation of the shaft modifies the function of the light. For instance, in the outward position, the operator can rotate the shaft in order to cause the switch to change the level of lighting. For example, at one rotation extreme the switch enables the light to be bright and at the other rotation extreme the switch causes the light to be dim.

SUMMARY OF THE INVENTION

It is an object of the present invention to provide a push-pull rotary switch having two electrical circuits in which at least one of the two electrical circuits is enabled at all times as the switch is pushed and pulled between inward and outward positions.

It is a further object of the present invention to provide a push-pull rotary switch having two ground circuits in which at least one of the two ground circuits is grounded at all times as the switch is pushed and pulled between inward and outward positions.

It is another object of the present invention to provide a push-pull rotary switch having two electrical circuits for controlling first and second sets of device functions in which at least one electrical circuit is enabled as the switch is pushed and pulled between inward and outward positions such that the switch can control the set of device functions associated with the enabled at least one electrical circuit.

It is still a further object of the present invention to provide a push-pull rotary switch having two electrical circuits for controlling first and second sets of device functions in which at least one electrical circuit is enabled as the switch is pushed and pulled between inward and outward positions, and configured such that the set of device functions associated with the enabled at least one electrical circuit may be controlled by rotating the switch.

It is still another object of the present invention to provide a push-pull rotary switch having two electrical circuits for controlling first and second sets of device functions in which at least one electrical circuit is enabled as the switch is pushed and pulled between inward and outward positions such that the switch can control the set of device functions associated with the enabled at least one electrical circuit, and configured such that the set of device functions associated with the enabled at least one electrical circuit may be further controlled by rotating the switch.

It is still a further object of the present invention to provide a push-pull rotary switch having at least one electrical circuit which is enabled at all times as the switch is pushed and pulled between inward and outward positions such that the enabled at least one electrical circuit can control different functions of a device as the switch is rotated.

In carrying out the above objects and other objects, the present invention provides a push-pull rotary switch having an electrical circuit board, first and second conductors, a shaft, a ground circuit trace, first and second circuit traces, and an electrical contactor. The electric circuit board includes a first circuit on a top side and a second circuit on a bottom side. The first and second circuits each have a ground pad and at least one contact pad. The first conductor is positioned above the top side of the board and is operable for contacting the ground pad and a contact pad of the first circuit. The second conductor is positioned below the bottom side of the board and is operable for contacting the ground pad and a contact pad of the second circuit.

The shaft extends along an axis through the first conductor, the board, and the second conductor. The shaft is rotatable about the axis and is moveable along the axis between inward and outward positions. The shaft is connected to the first and second conductors such that the first and second conductors rotate about the axis as the shaft rotates and move along the axis as the shaft moves along the axis. The first conductor contacts the ground pad and a contact pad of the first circuit to electrically connect the ground pad to the contacted contact pad of the first circuit when the shaft is in the inward position. The second conductor contacts the ground pad and a contact pad of the second circuit to electrically connect the ground pad to the contacted contact pad of the second circuit when the shaft is in the outward position.

The ground circuit trace is electrically connected to a ground source. The first circuit trace is electrically connected to the ground pad of the first circuit and the second circuit trace is electrically connected to the ground pad of the second circuit. The contactor is operable to be moved as the shaft moves along the axis between the inward and outward positions. The contactor connects the ground circuit trace to at least one of the first and second circuit traces at all times as the shaft moves along the axis such that at least one of the first and second circuits is enabled at all times as the shaft moves between inward and outward positions.

The contactor connects the ground circuit trace to the first circuit trace when the shaft is in the inward position and the contactor connects the ground circuit trace to the second circuit trace when the shaft is in the outward position. The contactor may be attached to a housing which is connected to the shaft to move up and down along the axis as the shaft moves between the inward and outward positions.

Each of the at least one contact pad of the first circuit is associated with a respective rotational position of the shaft. The first conductor contacts the ground pad and a contact pad associated with a first rotational position of the shaft to electrically connect the ground pad of the first circuit to the contacted contact pad of the first circuit when the shaft is in the inward position and is at the first rotational position of the shaft. Similarly, each of the at least one contact pad of the second circuit is associated with a respective rotational position of the shaft. The second conductor contacts the ground pad and a contact pad associated with a first rotational position of the shaft to electrically connect the ground pad of the second circuit to the contacted contact pad of the second circuit when the shaft is in the outward position and is at the first rotational position of the shaft. The contacted contact pad of the either the first and second circuits transmits a ground signal to a device to be controlled by the switch.

Either of the first and second conductors is a spring leaf having first and second members. The first member is operable for contacting the ground pad of one of the circuits when the shaft is in the inward position or outward position, and the second member is operable for contacting a contact pad of one of the circuits when the shaft is in the inward position. The first member includes a first boss for contacting the ground pad of the first circuit and the second member includes a second boss for contacting a contact pad of the first circuit.

DETAILED DESCRIPTION OF THE PREFERRED EMBODIMENT(S)

Figure 1:
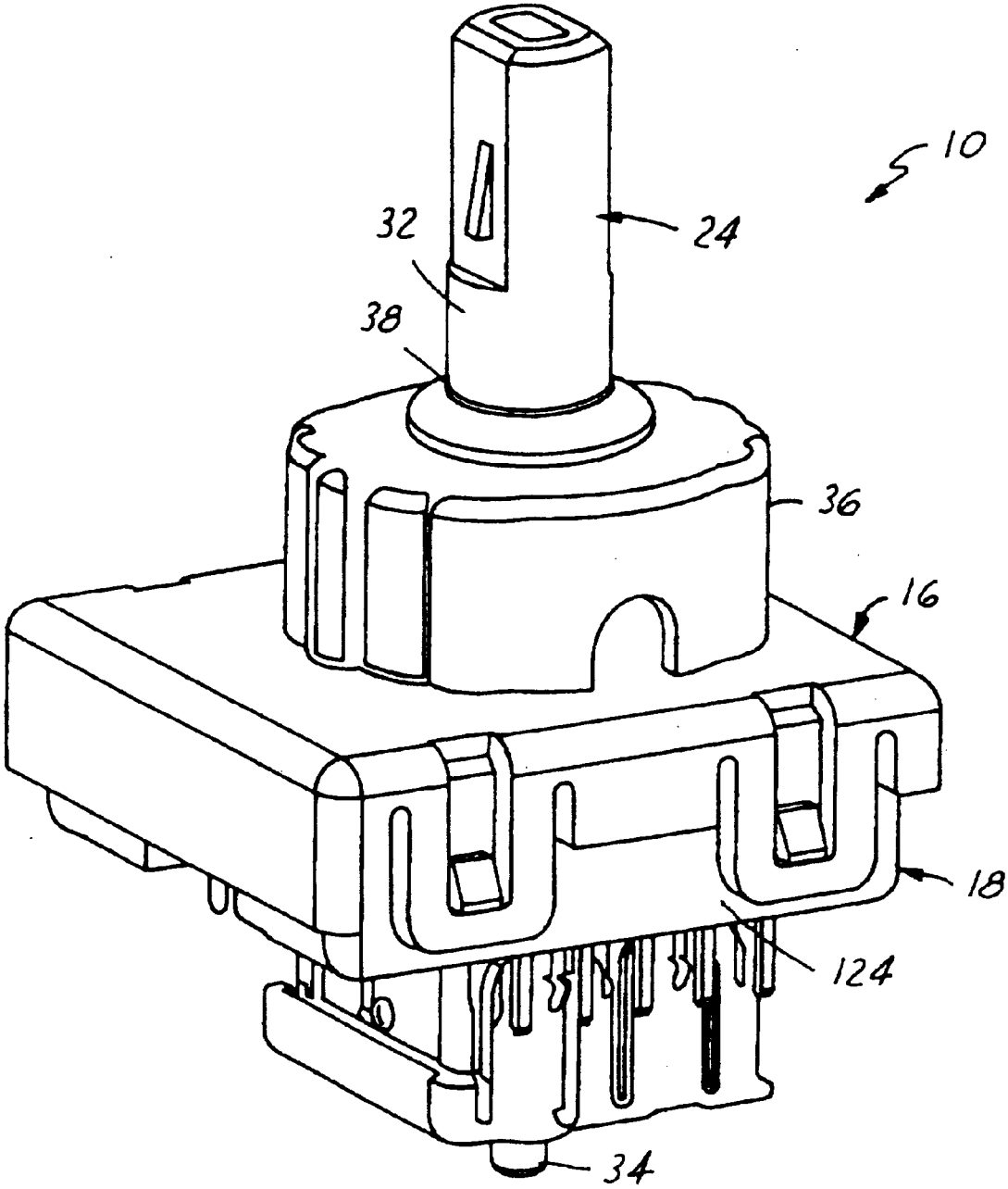
FIG. 1 illustrates a perspective view of an assembled push-pull rotary switch in accordance with a preferred embodiment of the present invention.
Figure 2:
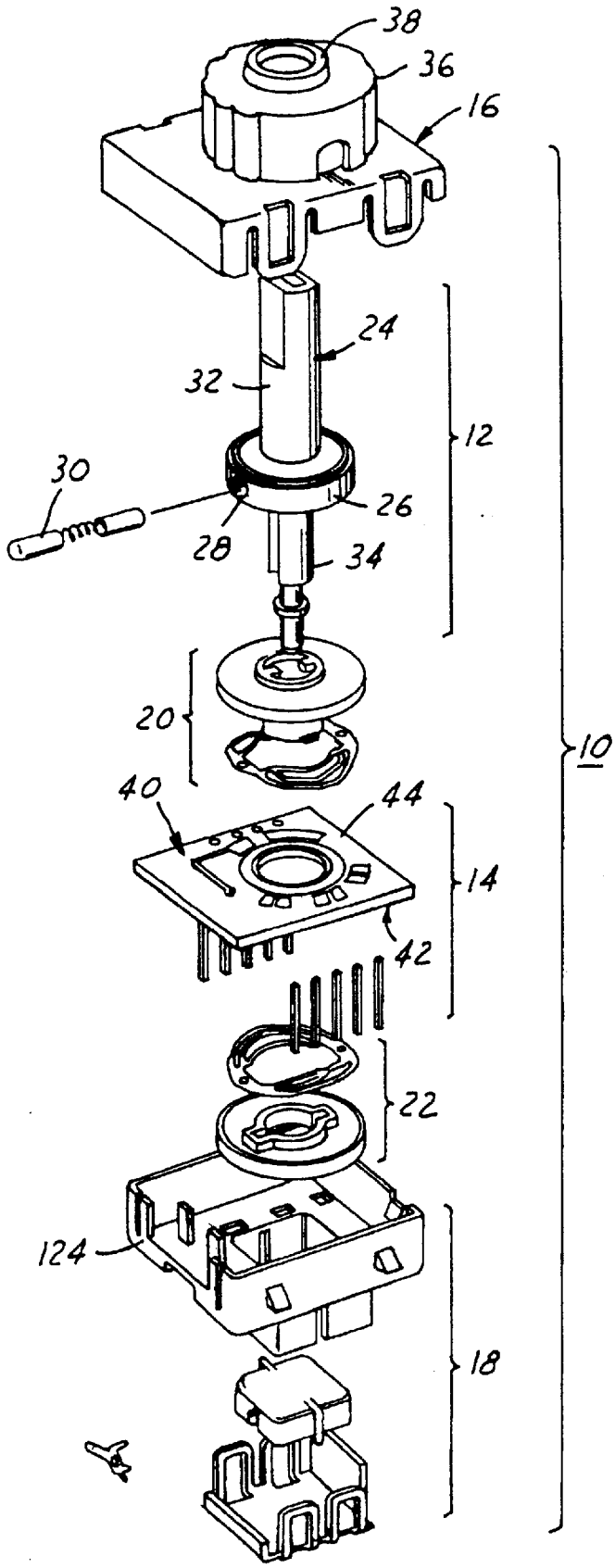
FIG. 2 illustrates an exploded view of the switch.
Figure 3:
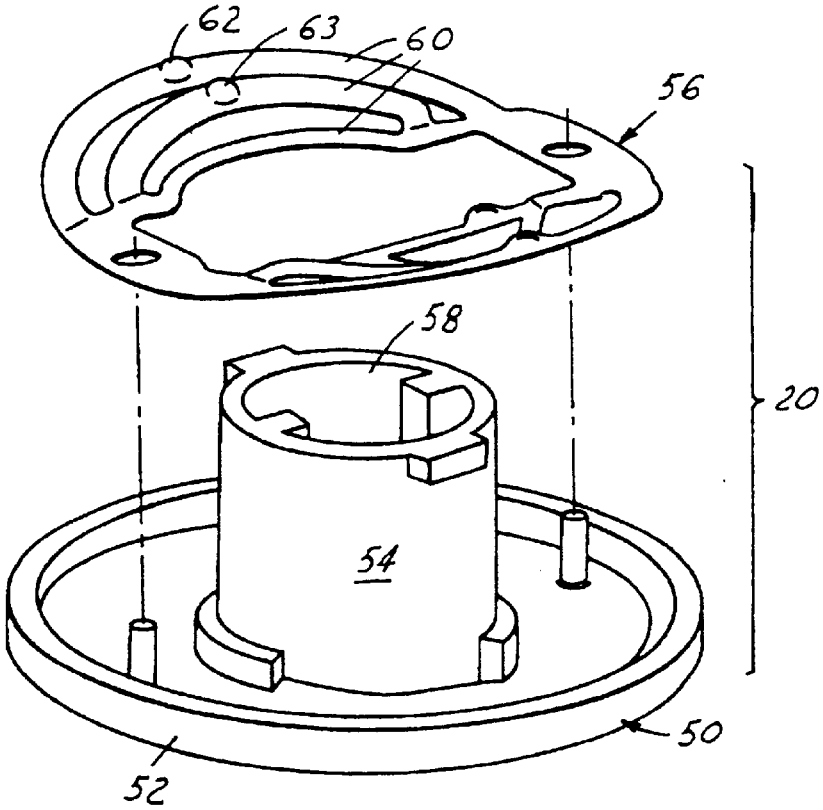
FIG. 3 illustrates an exploded view of a top carrier assembly of the switch.
Figure 4:
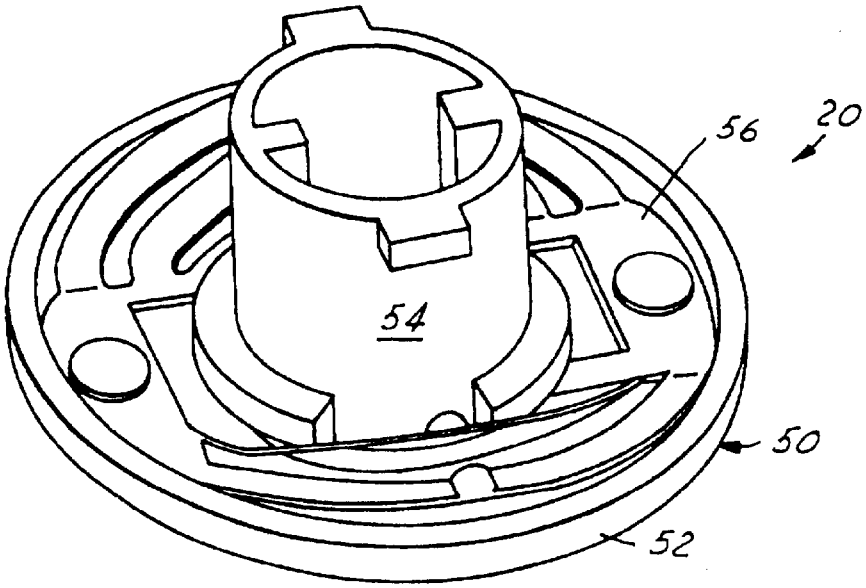
FIG. 4 illustrates a perspective view of the top carrier assembly.
Figure 5:
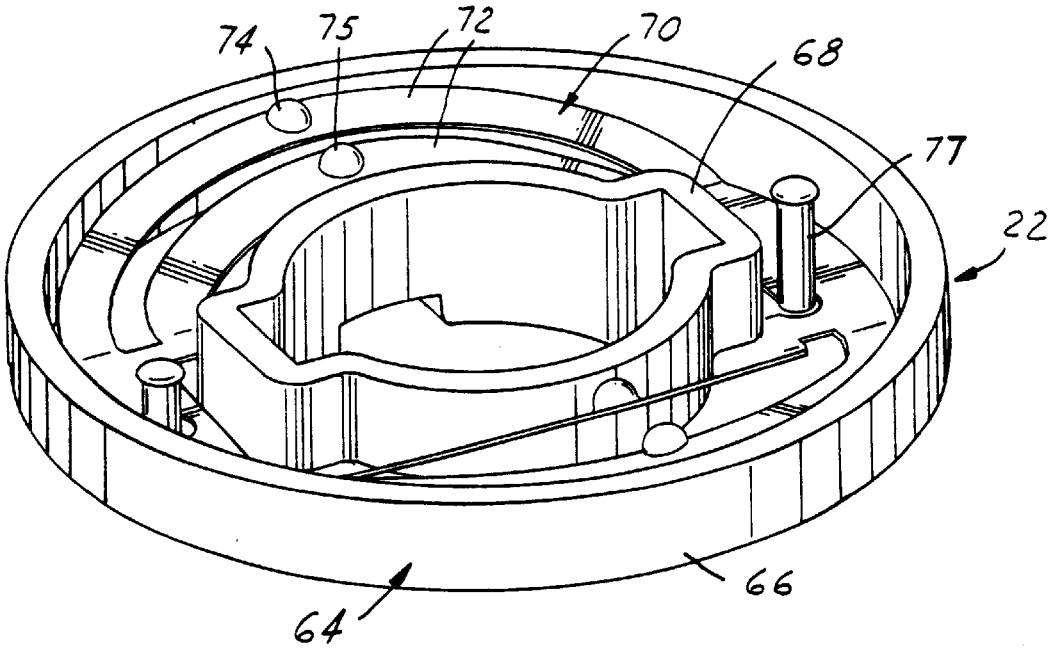
FIG. 5 illustrates a perspective view of a bottom carrier assembly of the switch.

Referring generally to the FIGURES, a push-pull rotary switch 10 in accordance with a first embodiment of the present invention is shown. Switch 10 generally includes a shaft assembly 12, an electrical circuit board assembly 14, a top housing assembly 16, a bottom housing assembly 18, a top carrier assembly 20, and a bottom carrier assembly 22. In general, switch 10 is operable to control first and second sets of functions of a device to be controlled. For example, the device may be the lighting system of a vehicle having a first set of standard light functions and a second set of fog light functions. The first set of standard light functions may include the following functions: auto, off, park, and headlight. The second set of fog light functions may include the following functions: auto with fog, park with fog, headlight with fog, and rear fog.

Switch 10 is operable to move between inward and outward positions and is operable to rotate between different rotational switch positions while being in either one of the inward and outward positions. The first and second sets of functions are associated with a respective one of the inward and outward positions of switch 10. For instance, switch 10 is operable to control the first set of functions when the switch is in the inward position. That is, switch 10 controls the standard light functions when the switch is in the inward position. Similarly, switch 10 is operable to control the second set of functions when the switch is in the outward position. That is, switch 10 controls the fog light functions when the switch is in the outward position.

The functions of each of the first and second sets of functions are associated with respective rotational positions of switch 10. For example, the first set of standard light functions of auto, off, park, and headlight is each associated with a respective rotational position of switch 10. Switch 10 is operable to control the functions of the first set of functions when the switch is in the inward position and rotated to a rotational position corresponding to the desired function. That is, switch 10 switches between the standard light functions as the switch is rotated when the switch is in the inward position. Similarly, the second set of fog light functions of auto with fog, park with fog, headlight with fog, and rear fog is each associated with a respective rotational position of switch 10. Switch 10 is operable to control the second sets of functions when the switch is in the outward position and rotated to a rotational position corresponding to the desired function. That is, switch 10 switches between the fog light functions as the switch is rotated when the switch is in the outward position.

The structure and function of switch 10 will now be described in more detail. Shaft assembly 12 includes a shaft 24 having a central circular body portion 26. Central body portion 26 includes a detent finger 28 which includes an opening completely extending through the central body portion. A spring 30 fits into detent finger 28 and extends through opposite ends of central body portion 26. A top end 32 of shaft 24 extends above central body portion 26 and a bottom end 34 of shaft 24 extends below the central body portion.

Top housing assembly 16 includes a circular detent housing 36 having a central opening 38. Top housing assembly 16 fits over shaft assembly 12 such that top end 32 of shaft 24 extends through central opening 38 of detent housing 36 and the detent housing houses central body portion 26 of the shaft. Shaft 24 is operable to be pushed and pulled along an axis 19 (best shown in FIG. 7) through central opening 38 between inward and outward positions. When moving from the outward position to the inward position, shaft 24 moves down along axis 19. Similarly, when moving from the inward position to the outward position, shaft 24 moves up along axis 19.

Thus, a larger length of top end 32 of shaft 24 extends above detent housing 36 while a lesser length of the remaining portion of the shaft extends below the detent housing when the shaft is pulled into the outward position. Similarly, a smaller length of top end 32 of shaft 24 extends above detent housing 36 while a greater length of the remaining portion of the shaft extends below the detent housing when the shaft is pushed into the inward position. In either the inward or outward positions, shaft 24 is further operable to rotate about axis 19.

Shaft 24 rotates about axis 19 to different predefined switch positions. As shaft 24 rotates, central body portion 26 of the shaft and spring 28 also rotate therewith about the interior of detent housing 36. As known in the art, the interior of detent housing 36 and spring 30 are operable with one another to define the different switch positions. That is, the interior of detent housing 36 includes opposed sets of recesses or the like associated with predefined rotatable switch positions. The opposed sets of recesses are configured to receive the ends of spring 30 when shaft 24 is rotated to the predefined switch positions. Thus, if there are four different switch positions, then detent housing 36 includes four pairs of recesses. In each switch position of shaft 24, the ends of spring 30 engage the pair of recesses associated with the particular switch position. As a result of spring 30 engaging a pair of recesses associated with a particular switch position, shaft 24 stays in that particular switch position until rotated to another switch position. When shaft 24 is rotated to another switch position, then ends of spring 30 engage the pair of recesses associated with this switch position.

Electrical circuit board assembly 14 includes a top side 40 and a bottom side 42. Top side 40 includes a first electrical circuit 44 and bottom side 42 includes a second electrical circuit 46. First and second electrical circuits 44 and 46 generally include the same circuit patterns and elements as shown in the FIGURES, but the circuit patters may be different from one another. As such, only the circuit pattern and elements of first electrical circuit 44 will be described in greater detail herein with like reference numbers being understood for the circuit pattern and elements of second electrical circuit 46. Each of first and second electrical circuits 44 and 46 are operable for generating different signals to control first and second sets of functions of a device to be controlled.

Top carrier assembly 20 is positioned above top side 40 of electrical circuit board assembly 14. Bottom carrier assembly 22 is positioned below bottom side 42 of electrical circuit board assembly 14. Top carrier assembly 20 includes a top carrier 50 having a top cover 52 and an extending portion 54. Extending portion 54 has a generally circular perimeter defining a hollow cavity 58. Top carrier assembly 20 further includes a first electrically conductive leaf spring 56. Leaf spring 56 includes a plurality of individual conductive members 60 each having a raised boss 62 and 63. Each conductive member 60 rises above the remaining portion of leaf spring 56. Leaf spring 56 is heat staked to the bottom of top cover 52 such that conductive members 60 are positioned around the exterior of extending portion 54 and extend away from the bottom of the top cover.

Bottom carrier assembly 22 includes a bottom carrier 64 having a bottom cover 66 and a central cavity portion 68. Bottom carrier assembly 22 further includes a second electrically conductive leaf spring 70. Leaf spring 70 also includes a plurality of individual conductive members 72 each having a raised boss 74 and 75. Each conductive member 72 rises above the remaining portion of leaf spring 70. Leaf spring 70 is heat staked with stakes 77 to the top of bottom cover 66 such that conductive members 72 are positioned around the exterior of central cavity portion 68 and extend away from the top of the bottom cover.

Figure 6:
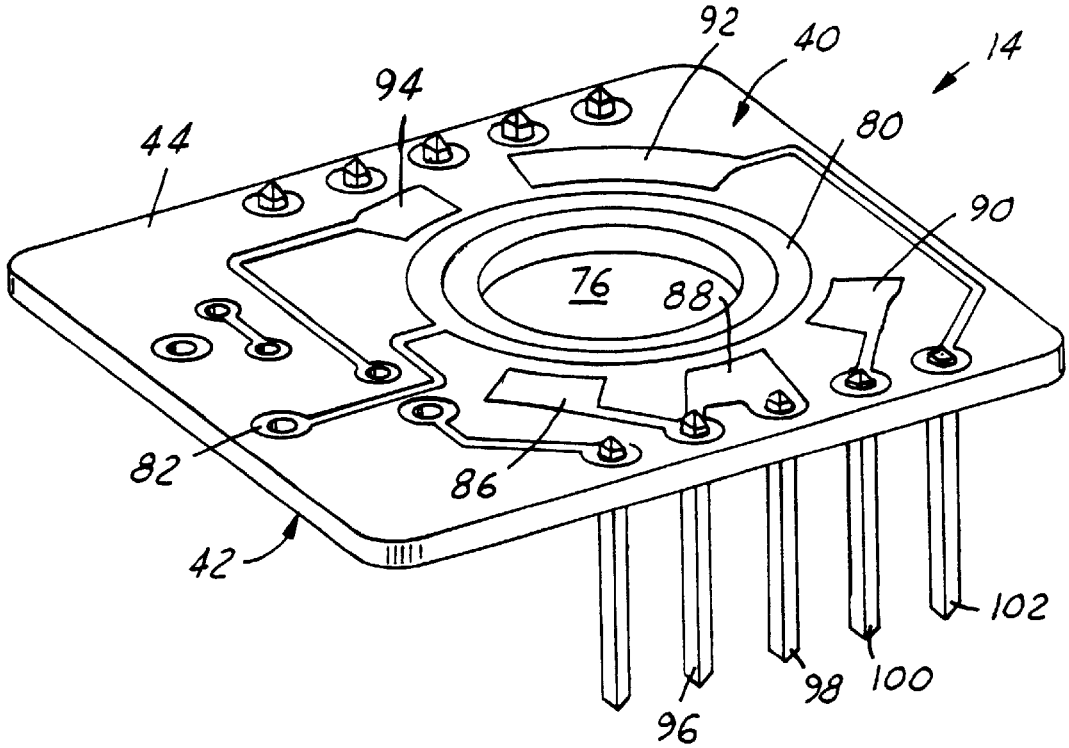
FIG. 6 illustrates a perspective view of an electrical circuit board assembly of the switch.
Figure 7:
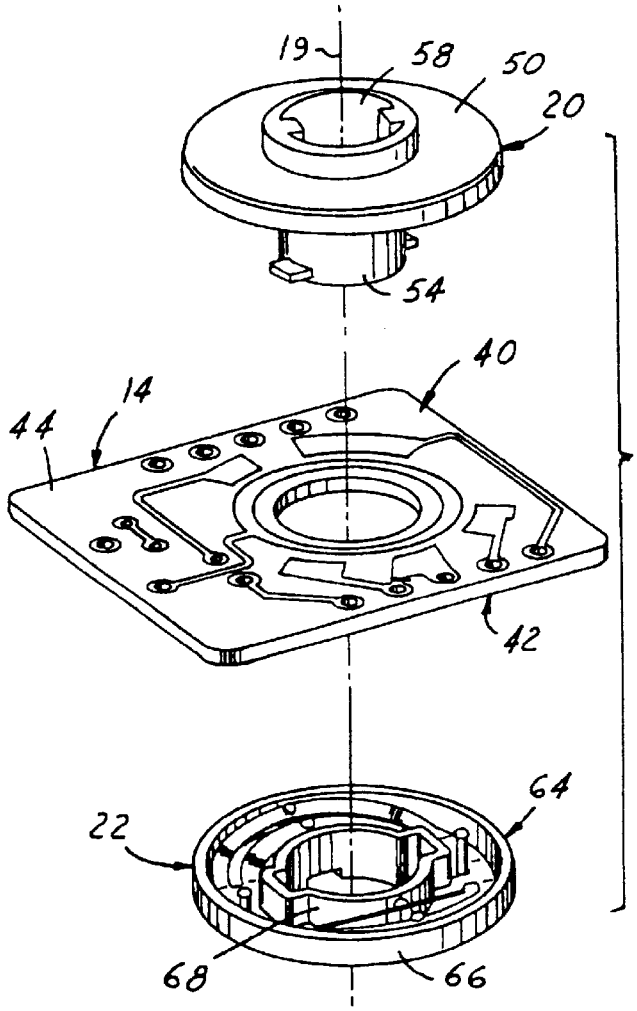
FIG. 7 illustrates an exploded view of the top carrier assembly, the electrical circuit board assembly, and the bottom carrier assembly.
Figure 8:
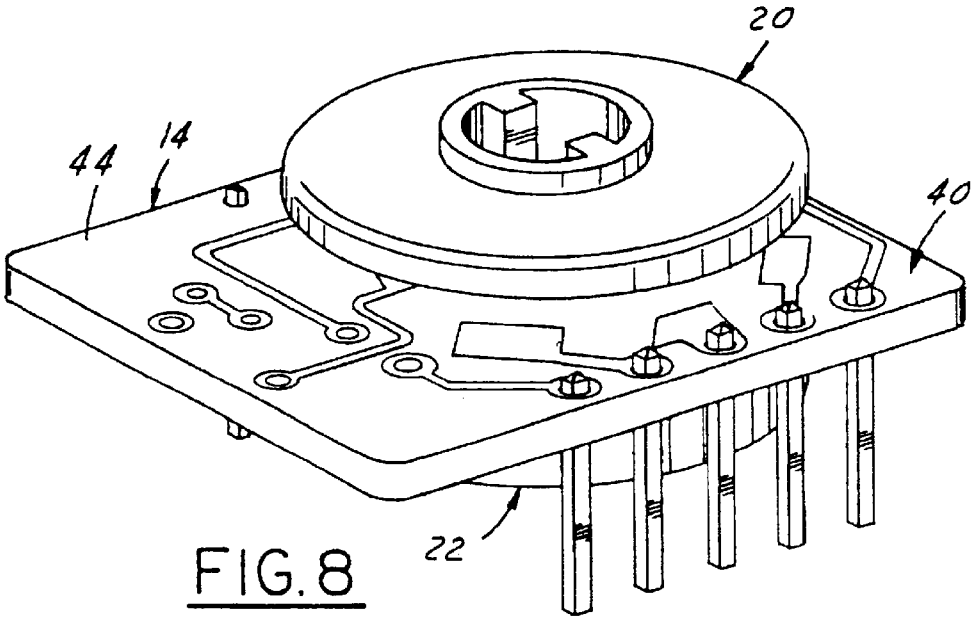
FIG. 8 illustrates a top perspective view of the top carrier assembly, the electrical circuit board assembly, and the bottom carrier assembly all assembled together.
Figure 9:
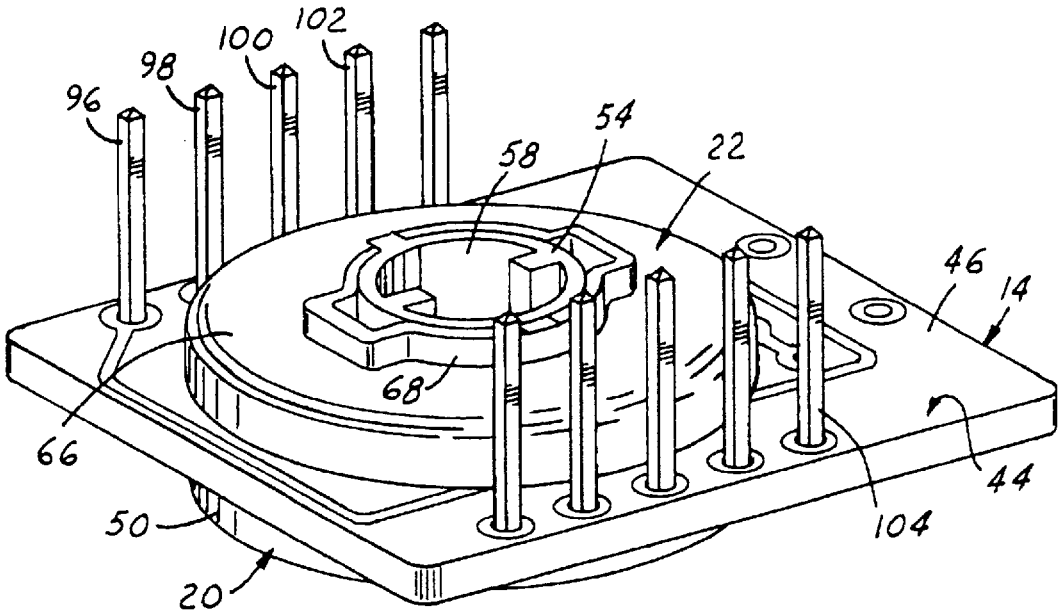
FIG. 9 illustrates a bottom perspective view of the top carrier assembly, the electrical circuit board assembly, and the bottom carrier assembly all assembled together.

As best shown in FIGS. 6 and 7, electrical circuit board assembly 14 includes a central opening 76. Extending portion 54 of top carrier assembly 20 extends through central opening 76 of electrical circuit board assembly 14 and is received by central cavity portion 68 of bottom carrier assembly 22. In this position, as best shown in FIGS. 8 and 9, top and bottom carrier assemblies 20 and 22 are connected to one another with electrical circuit board assembly 14 interposed between.

Lower end 34 of shaft 24 extends through top carrier assembly 20, electrical circuit board assembly 14, and bottom carrier assembly 22. Specifically, lower end 34 of shaft 24 extends through hollow cavity 58 of top carrier assembly 20, central opening 76 of electrical circuit board assembly 14, and central cavity portion 68 of bottom carrier assembly 22. Top carrier assembly 20 is connected to lower end 34 of shaft 24 to rotate about axis 19 as the shaft rotates about the axis. Similarly, bottom carrier assembly 22 is connected to lower end 34 of shaft 24 to rotate about axis 19 as the shaft rotates about the axis. Accordingly, both first and second leaf springs 56 and 70 rotate about axis 19 as shaft 24 rotates.

Top and bottom carrier assemblies 20 and 22 also move along axis 19 as shaft 24 is pushed and pulled between inward and outward positions along the axis. Thus, when shaft 24 is moved to the inward position, top carrier assembly 20 moves down along axis 19 toward top side 40 of electrical circuit board assembly 14 and bottom carrier assembly 22 moves down along the axis away from bottom side 42 of the electrical circuit board assembly. Similarly, when shaft 24 is moved to the outward position, top carrier assembly 20 moves up along axis 19 away from top side 40 of electrical circuit board assembly 14 and bottom carrier assembly 22 move up along the axis toward bottom side 42 of the electrical circuit board assembly.

The length of extending portion 54 of top carrier assembly 20 is set such that at least one of top and bottom carrier assemblies 20 and 22 is in physical contact with the corresponding sides 40 and 42 of electrical circuit board assembly 14 as shaft 24 moves along axis 19. Accordingly, top carrier assembly 20 is in physical contact with top side 40 of electrical circuit board assembly 14 when shaft 24 is in the inward position. Similarly, bottom carrier assembly 22 is in physical contact with bottom side 42 of electrical circuit board assembly 14 when shaft 24 is in the outward position.

When either of top and bottom carrier assemblies 20 and 22 is in physical contact with top and bottom sides 40 and 42 of electrical circuit board assembly 14, respective first and second leaf springs 56 and 70 make electrical contact with first and second electrical circuits 44 and 46. Thus, first leaf spring 56 makes electrical contact with first electrical circuit 44 when shaft 24 is in the inward position and second leaf spring 70 makes electrical contact with second electrical circuit 46 when the shaft is in the outward position.

Figure 10:
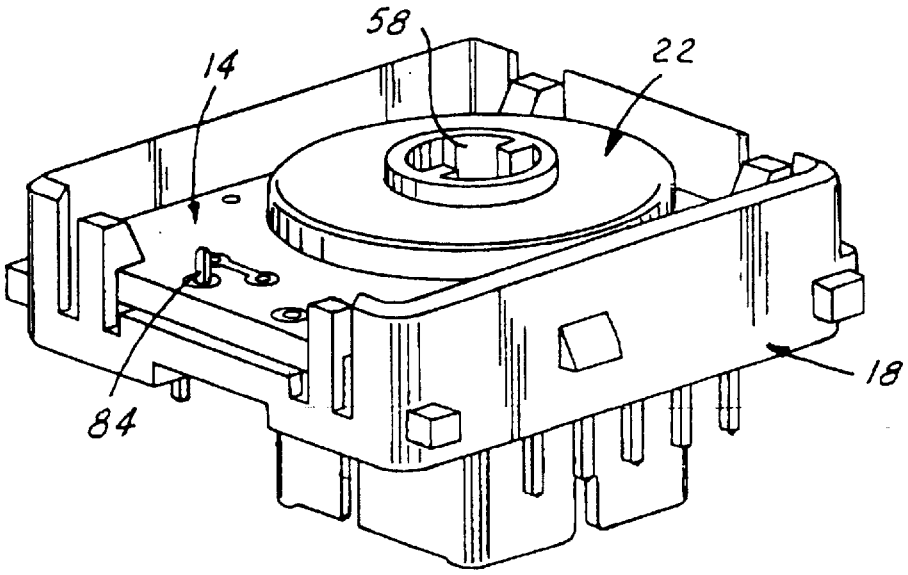
FIG. 10 illustrates a perspective view of the top carrier assembly, the electrical circuit board assembly, and the bottom carrier assembly all assembled together and partially enclosed by a bottom housing assembly of the switch.
Figure 11:
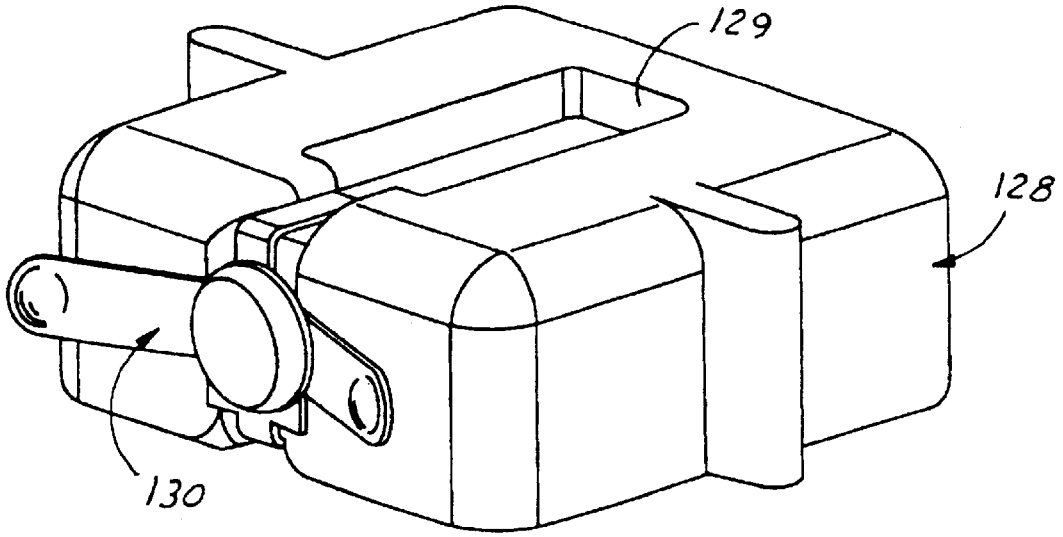
FIG. 11 illustrates a perspective view of a bottom carrier and an electrical connector of the bottom housing assembly.

First and second electrical circuits 44 and 46 each include a ground pad 80 extending around central opening 76 of electrical circuit board assembly 14 and a ground receptacle 82. Ground receptacle 82 is configured to receive a ground pin 84 (best shown in FIG. 10). Ground pad 80 is electrically connected to a ground receptacle 82 and is grounded when a ground pin is in electrical contact with the ground receptacle. (It is to be understood that different voltages other than ground may be applied by a ground pin. In this case, the ground pin would be referred to as a power pin or the like and ground pad 80 would have the same voltage as the power pin.)

First and second electrical circuits 44 and 46 each further include individual electrical contact pads 86, 88, 90, 92, and 94. Electrical contact pads 86, 88, 90, 92, and 94 are not in electrically contact with ground pad 80 and are insulated therefrom. Each electrical contact pad 86, 88, 90, 92, and 94 is connected to a respective pin 96, 98, 100, 102, and 104 which may be individually connected to a device to be controlled.

As explained in greater detail below, each electrical contact pad 86, 88, 90, 92, and 94 corresponds to a rotational position of shaft 24 and is enabled when the shaft is moved to the rotational position corresponding to the electrical contact pad. For instance, a first contact pad 86 corresponds to a first rotational position of shaft 24 and a second contact pad 88 corresponds to a second rotational position of the shaft. When shaft 24 is in the first rotational position, then first contact pad 86 is enabled and when the shaft is in the second rotational position, then second contact pad 88 is enabled.

When shaft 24 is in the inward position and is rotated to a first rotational position, first leaf spring 56 electrically contacts first electrical circuit 44. Specifically, raised boss 63 of an inner conductor member 60 electrically contacts ground pad 80 and raised boss 62 of an outer conductor member 60 electrically contacts the contacts pad 86, 88, 90, 92, and 94 associated with the first rotational position. Thus, the contact pad contacted by first leaf spring 56 is grounded as the first leaf spring electrically connects this contact pad to ground pad 80. Consequently, the pin associated with the grounded contact pad is also grounded and hence, a ground signal from this pin is transmitted to a device to be controlled. The device is then controlled in accordance with this ground signal from the pin. For example, the device such as a light may be controlled to provide parking light when a ground signal from the pin associated with the grounded contact pad is transmitted.

As first leaf spring 56 rotates about axis 19 as shaft 24 is rotated to a second rotational position, raised boss 63 maintains electrical contact with ground pad 60, but raised boss 62 moves from the first contact pad to a second contact pad associated with the second rotational position. Thus, the second contact pad is now grounded as first leaf spring 56 electrically connects the second contact pad to ground pad 80. Consequently, the second pin associated with the second contact pad is also grounded and hence, the second pin transmits a ground signal to the device. The device is then controlled in accordance with the ground signal from the second pin. For instance, the lighting device may be controlled to turn off the light when the second pin transmits a ground signal.

When first leaf spring 56 contacts the second contact pad, the first contact pad and the other contact pads are not grounded as there is no electrical contact between ground pad 80 and these contact pads. That is, first leaf spring 56 does not electrically connect these other contact pads to ground pad 80. Similar operation with respect to second leaf spring 70 and second electrical circuit 46 occurs when shaft 24 is in the outward position and is rotated to different rotational positions.

Figure 12:
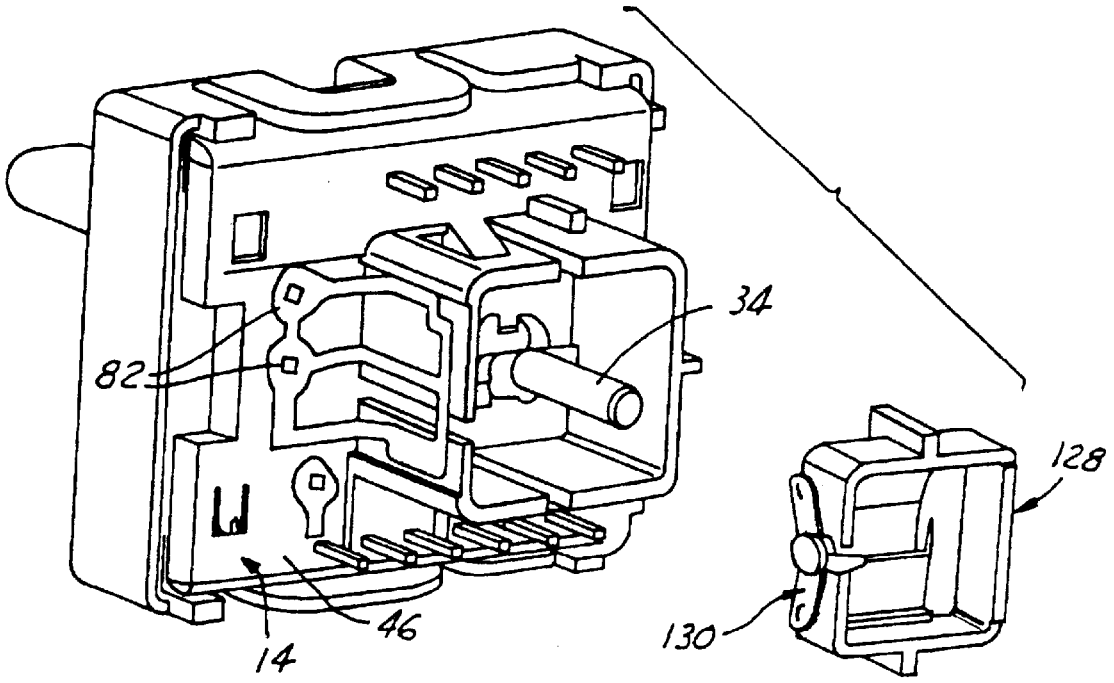
FIG. 12 illustrates a view of the switch assembled without the bottom housing assembly next to the bottom carrier and the electrical connector of the boom housing assembly.

As described above and with reference to FIGS. 12 and 13, ground pad 80 of first and second circuits 44 and 46 is electrically connected to a respective ground pin 84. Each ground pin 84 is electrically connected by respective first and second circuit traces 120 and 122 to respective first and second terminals. First and second circuit traces 120 and 122 are connected to a housing 124 of bottom housing assembly 18. First and second circuit traces 120 and 122 are positioned adjacent one another but do not physically touch. Housing 124 further includes a ground circuit trace 126 which is electrically connected to a ground (or other voltage) source or terminal.

Bottom housing assembly 18 further includes a bottom carrier 128. Bottom end 34 of shaft 24 extends through an opening 129 of bottom carrier 128. Bottom carrier 128 is connected to shaft 24 such that the bottom carrier moves up and down as the shaft moves along axis 19 between inward and outward positions. An electrically conductive contactor 130 is attached to bottom carrier 128. Contactor 130 also moves up and down as shaft 24 moves along axis 19 as shown by reference numeral 132 in FIG. 13.

Figure 13:
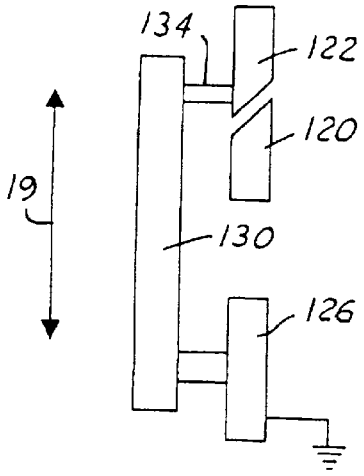
FIG. 13 illustrates a schematic view of an electrical connector and electrical terminals of the bottom housing assembly.

Contactor 130 is generally operable to connect at least one of first and second circuit traces 120 and 122 to ground circuit trace 126. At all times during movement of shaft 24 along axis 19 between inward and outward positions, contactor 130 is configured to contact ground circuit trace and at least one of first and second circuit traces 120 and 122. For example, as shown in FIG. 13, contactor 130 contacts second circuit trace 122 and ground circuit trace 126. This occurs when shaft 24 is in the outward position such that the shaft moves up along axis 19. As a result of contactor 130 contacting ground circuit trace 126 and second circuit trace 122, the second circuit trace becomes grounded. Consequently, ground pad 80 of second circuit 46 also becomes grounded. Second spring 70 is also moved to contact ground pad 80 of second circuit 46 as the second spring is moved toward and contacts the second circuit when shaft 34 is in the outward position. Thus, second spring 70 may then connect the grounded ground pad 80 to different contact pads in order to transmit ground signals from the contact pads of the second circuit 46.

Similarly, contactor 130 contacts first circuit trace 120 and ground circuit trace 126 when shaft 24 is in the inward position and is moved down along axis 19. As a result of contactor 130 contacting ground circuit trace 126 and first circuit trace 120, the first circuit trace becomes grounded. Consequently, ground pad 80 of first circuit 44 also becomes grounded. First spring 56 is also moved to contact ground pad 80 of first circuit 44 as the first spring is moved toward and contacts the first circuit when shaft 34 is in the inward position. Thus, first spring 56 may then connect the grounded ground pad 80 to different contact pads in order to transmit ground signals from the contact pads of first circuit 44.

Contactor 130 and first and second circuit traces 120 and 122 are configured such that the contactor always touches at least one of the first and second circuit traces while always touching ground circuit trace 126. To this end, contactor 130 includes a contact point 134 or the like having a size which is greater than the distance separating first and second circuit traces 120 and 122. Thus, contact point 134 always contacts at least one or both of first and second circuit traces 120 and 122. In the inward position of shaft 34, contact point 134 contacts first circuit trace 120 and in the outward position of the shaft, the contact point contacts second circuit trace 122. When shaft 34 is moving between the inward and outward positions, contact point 134 contacts both of first and second circuit traces 120 and 122. This ensures that an electrical connection between one the first and second circuits 44 and 46 with ground circuit trace 126 is always made before an electrical connection between the ground circuit trace with the other one of the first and second circuits is broken.

Figure 14:
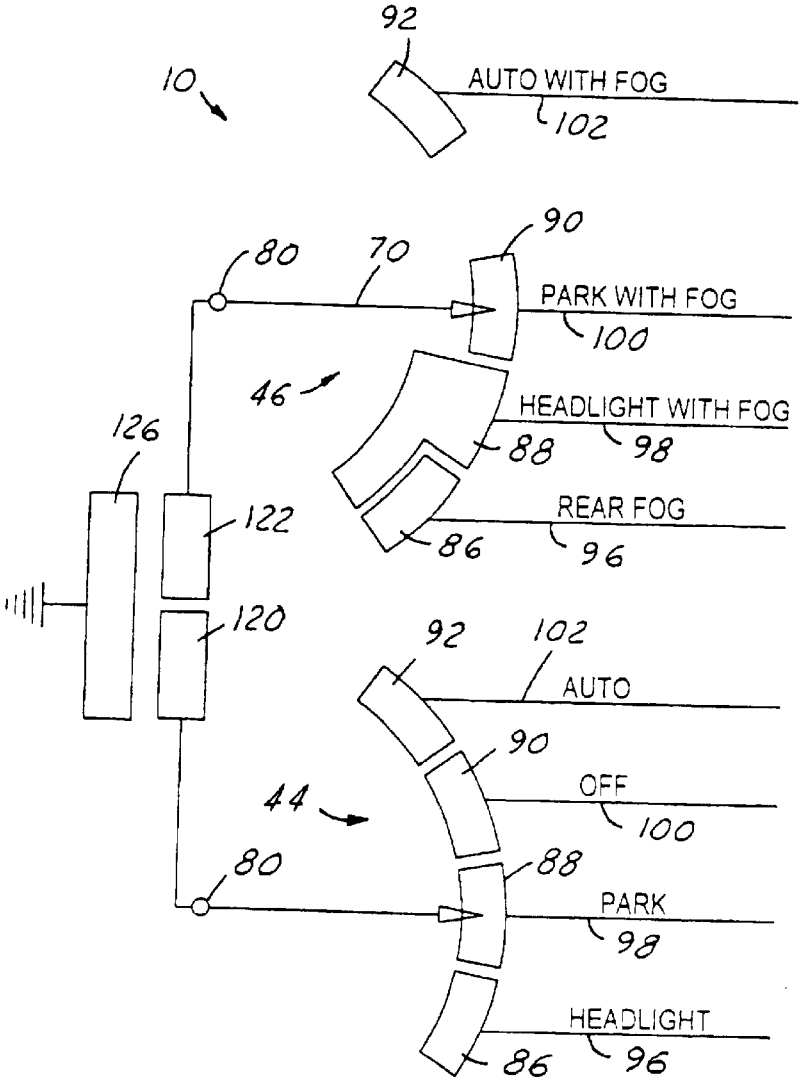
FIG. 14 illustrates an exemplary schematic layout of the switch deployed in an automotive lighting application.

Referring now to FIG. 14, an exemplary schematic layout of switch 10 deployed in an automotive lighting application is shown. As shown in FIG. 14, each of first and second circuits 44 and 46 have contact pads 86, 88, 90, and 92. Each contact pad 86, 88, 90, and 92 is connected by a respective pin 96, 98, 100, and 102 to a device such as a lighting system to be controlled. Each pin 96, 98, 100, and 102 of first and second circuits 44 and 46 is associated with different lighting functions. For instance, pin 96 of first circuit 44 is associated with headlight lighting and pin 96 of second circuit 46 is associated with rear fog lighting. When a contact pad 86, 88, 90, or 92 is connected by either of first and second springs 56 and 70 to ground pad 80, then the pin associated with the connected contact pad transmits a ground signal to the lighting system to be controlled. The lighting system is then controlled accordingly. For instance, the lighting system provides the headlight lighting when pin 96 of first circuit 44 transmits a ground signal. Similarly, the lighting system provides the rear fog lighting when pin 96 of second circuit 46 transmits a ground signal.

Thus it is apparent that there has been provided, in accordance with the present invention, a push-pull rotary switch having two electrical circuits in which at least one of the two electrical circuits is enabled at all times as the switch is pushed and pulled between inward and outward positions that fully satisfies the objects, aims, and advantages set forth above. While embodiments of the present invention have been illustrated and described, it is not intended that these embodiments illustrate and describe all possible forms of the invention. Rather, the words used in the specification are words of description rather than limitation, and it is understood that various changes may be made without departing from the spirit and scope of the present invention.

What is claimed is:

1. A push-pull rotary switch comprising:

a board having a first circuit on a top side and a second circuit on a bottom side, the first and second circuits each having a ground pad and at least one contact pad;

a first conductor positioned above the top side of the board and operable for contacting the ground pad and a contact pad of the first circuit;

a second conductor positioned below the bottom side of the board and operable for contacting the ground pad and a contact pad of the second circuit;

a shaft extending along an axis through the first conductor, the board, and the second conductor, the shaft being rotatable about the axis and moveable along the axis between inward and outward positions, the shaft connected to the first and second conductors such that the first and second conductors rotate about the axis as the shaft rotates and move along the axis as the shaft moves along the axis, wherein the first conductor contacts the ground pad and a contact pad of the first circuit to electrically connect the ground pad to the contacted contact pad of the first circuit when the shaft is in the inward position, wherein the second conductor contacts the ground pad and a contact pad of the second circuit to electrically connect the ground pad to the contacted contact pad of the second circuit when the shaft is in the outward position;

a ground circuit trace electrically connected to a ground source;

a first circuit trace electrically connected to the ground pad of the first circuit and a second circuit trace electrically connected to the ground pad of the second circuit; and a contactor operable to be moved as the shaft moves along the axis between the inward and outward positions, wherein the contactor connects the ground circuit trace to at least one of the first and second circuit traces at all times as the shaft moves along the axis.

2. The switch of claim 1 wherein:

the contactor connects the ground circuit trace to the first circuit trace when the shaft is in the inward position.

3. The switch of claim 1 wherein:

the contactor connects the ground circuit trace to the second circuit trace when the shaft is in the outward position.

4. The switch of claim 1 wherein:

each of the at least one contact pad of the first circuit is associated with a respective rotational position of the shaft, wherein the first conductor contacts the ground pad and a contact pad associated with a first rotational position of the shaft to electrically connect the ground pad of the first circuit to the contacted contact pad of the first circuit when the shaft is in the inward position and is at the first rotational position of the shaft.

5. The switch of claim 1 wherein:

each of the at least one contact pad of the second circuit is associated with a respective rotational position of the shaft, wherein the second conductor contacts the ground pad and a contact pad associated with a first rotational position of the shaft to electrically connect the ground pad of the second circuit to the contacted contact pad of the second circuit when the shaft is in the outward position and is at the first rotational position of the shaft.

6. The switch of claim 1 wherein:

the contacted contact pad of the first circuit transmits a ground signal to a device to be controlled by the switch.

7. The switch of claim 1 wherein:

the contacted contact pad of the second circuit transmits a ground signal to a device to be controlled by the switch.

8. The switch of claim 1 wherein:

the first conductor is a spring leaf.

9. The switch of claim 8 wherein:

the spring leaf includes first and second members, wherein the first member is operable for contacting the ground pad of the first circuit when the shaft is in the inward position, and the second member is operable for contacting a contact pad of the first circuit when the shaft is in the inward position.

10. The switch of claim 9 wherein:

the first member includes a first boss for contacting the ground pad of the first circuit and the second member includes a second boss for contacting a contact pad of the first circuit.

11. The switch of claim 1 wherein:

the contactor is attached to a housing which is connected to the shaft to move up and down along the axis as the shaft moves between the inward and outward positions.

12. A push-pull rotary switch comprising:

a board having a first circuit on a top side and a second circuit on a bottom side, the first and second circuits each having a power pad and at least one contact pad;

a first conductor positioned above the top side of the board and operable for contacting the power pad and a contact pad of the first circuit;

a second conductor positioned below the bottom side of the board and operable for contacting the power pad and a contact pad of the second circuit;

a shaft extending along an axis through the first conductor, the board, and the second conductor, the shaft being rotatable about the axis and moveable along the axis between inward and outward positions, the shaft connected to the first and second conductors such that the first and second conductors rotate about the axis as the shaft rotates and move along the axis as the shaft moves along the axis, wherein the first conductor contacts the power pad and a contact pad of the first circuit to electrically connect the power pad to the contacted contact pad of the first circuit when the shaft is in the inward position, wherein the second conductor contacts the power pad and a contact pad of the second circuit to electrically connect the power pad to the contacted contact pad of the second circuit when the shaft is in the outward position;

a power circuit trace electrically connected to a power source;

a first circuit trace electrically connected to the power pad of the first circuit and a second circuit trace electrically connected to the power pad of the second circuit; and a contactor operable to be moved as the shaft moves along the axis between the inward and outward positions, wherein the contactor connects the power circuit trace to at least one of the first and second circuit traces at all times as the shaft moves along the axis.

13. The switch of claim 12 wherein:

the contactor connects the power circuit trace to the first circuit trace when the shaft is in the inward position.

14. The switch of claim 12 wherein:

the contactor connects the power circuit trace to the second circuit trace when the shaft is in the outward position.

15. The switch of claim 12 wherein:

the contacted contact pad of the first circuit transmits a power signal to a device to be controlled by the switch.

16. The switch of claim 12 wherein:

the contacted contact pad of the second circuit transmits a power signal to a device to be controlled by the switch.

* * * * *